US007952263B1

(12) United States Patent
Ireland

(10) Patent No.: US 7,952,263 B1
(45) Date of Patent: May 31, 2011

(54) MULTI-SPARK INDUCING SPARK PLUG AND ASSOCIATED METHOD

(76) Inventor: Verner R. Ireland, Madison, MD (US)

( * ) Notice: Subject to any disclaimer, the term of this patent is extended or adjusted under 35 U.S.C. 154(b) by 162 days.

(21) Appl. No.: 12/378,360

(22) Filed: Feb. 13, 2009

Related U.S. Application Data

(60) Provisional application No. 61/065,721, filed on Feb. 15, 2008.

(51) Int. Cl.
*H01T 13/20* (2006.01)

(52) U.S. Cl. ..... 313/140; 313/141

(58) Field of Classification Search ..... 313/118, 313/140–143
See application file for complete search history.

(56) References Cited

U.S. PATENT DOCUMENTS 5,856,724 A * 1/1999 Chiu et al. ..... 313/141

* cited by examiner

*Primary Examiner* — Joseph L Williams

(57) ABSTRACT

A spark plug for use with an internal combustion vehicle engine preferably includes a housing having a single primary electrode and a single grounding electrode located subjacent to the single primary electrode. The single primary and grounding electrodes are spaced apart and thereby define a gap therebetween. A present invention further includes a mechanism for separately inducing a plurality of electric sparks between the single primary electrode and the single grounding electrode, respectively. Each of the electric sparks preferably has a separate and mutually exclusive firing point initiating from the single primary electrode and terminating at the single grounding electrode.

12 Claims, 6 Drawing Sheets

MULTI-SPARK INDUCING SPARK PLUG AND ASSOCIATED METHOD

CROSS REFERENCE TO RELATED APPLICATIONS

This application claims the benefit of U.S. Provisional Application No. 61/065,721, filed Feb. 15, 2008, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to ignition devices and, more particularly, to an ignition device for providing a multi-spark inducing spark plug for igniting fuel in an engine.

2. Prior Art

A known spark plug for providing ignition of an internal combustion engine such as an automotive engine, comprises: an insulator having an axial hole in the axial direction of the spark plug, a center electrode disposed in a tip end side of the axial hole of the insulator; a metal shell surrounding the insulator; a first ground electrode in which one end is bonded to the metal shell and another end portion opposes a tip end face of the center electrode; and a second ground electrode in which one end is bonded to the metal shell, and another end opposes a side peripheral face of the center electrode or that of the insulator.

In such a spark plug, spark discharge is caused in a first discharge gap formed by the center electrode and the first ground electrode to ignite an air-fuel mixture. On the other hand, carbon or the like may adhere to the tip end face of the insulator to result in so-called "fouling." In this case, spark discharge creeping on the surface of the insulator occurs in a second discharge gap which is formed by the second ground electrode and the side peripheral face of the center electrode.

Recently, the demand for further enhancing the performance of an engine is increasing, and there is a need to further improve the ignitability of a spark plug. In a spark plug in which only a first ground electrode is disposed (a second ground electrode is not disposed), the method described below is effective in improving the ignitability.

A method in which, in a noble metal tip (precious metal tip) joined to an inner side face of the another end portion of a first ground electrode body, the distance in the axial direction between a face opposing the center electrode and the inner side face (hereinafter, also referred to as protrusion amount) is increased, is also effective.

The reason is as follows. A flame kernel produced in a first discharge gap which is formed by the center electrode and the first ground electrode is caused to grow by swirling or the like. When the protrusion amount of the noble metal tip is small, however, the distance between the first discharge gap and the first ground electrode body is so small that, in an early stage of the growing process of the flame kernel, the flame kernel makes contact with the first ground electrode body. As a result, the growth of the flame kernel may be impeded (hereinafter, this is also referred to as a flame quenching effect).

Therefore, a structure in which the protrusion amount of a noble metal tip is made as large as possible so as to expedite growth of a flame kernel is often employed. Obviously, it would be advantageous to develop a spark plug that overcomes this problem, while still enhancing the performance of an engine.

BRIEF SUMMARY OF THE INVENTION

In view of the foregoing background, it is therefore an object of the present invention to provide an apparatus for a spark plug for use with an internal combustion vehicle engine. These and other objects, features, and advantages of the invention are provided by a spark plug including a housing having a single primary electrode and a single grounding electrode located subjacent to the single primary electrode. The single primary and grounding electrodes are spaced apart and thereby define a gap therebetween.

The present invention further includes a mechanism for separately inducing a plurality of electric sparks between the single primary electrode and the single grounding electrode respectively. In one embodiment, the plurality of electric sparks inducing mechanism is directly attached to the single grounding electrode and situated subjacent to the single primary electrode respectively.

Notably, each of the electric sparks has a separate and mutually exclusive firing point initiating from the single primary electrode and terminating at the single grounding electrode. In this manner, each of the electric sparks travels along a mutually exclusive travel path defined within the gap. In particular, first, second and third ones of the plurality of electric sparks travels along a corresponding one of the first, second and third distances (as described hereinbelow).

In a preferred embodiment, the plurality of electric sparks inducing mechanism preferably includes an electro-conductive chip statically and fixedly connected to the single grounding electrode. As an example, the electro-conductive chip may be formed from a metal selected from a group including: steel alloy, copper-nickel alloy and platinum.

In one embodiment, the single primary electrode is preferably attached to the distal end of the housing and may extend vertically downward therefrom. The single grounding electrode may also extend downwardly from the distal end of the housing and may further terminate at a location subjacent to the single primary electrode.

In a preferred embodiment, the electro-conductive chip preferably includes a first leg having a vertical face juxtaposed adjacent to the single primary electrode and registered parallel thereto. The chip may also include a second leg having a horizontal face juxtaposed beneath the single primary electrode and registered orthogonal thereto. In particular, the second leg preferably extends to a lateral tip of the single grounding electrode. Each of the vertical and horizontal faces are preferably planar and exposed to the single primary electrode to receive first and second ones of the plurality of electric sparks respectively.

The vertical and horizontal faces may meet at a corner of the first and second legs respectively such that a third one of the plurality of electric sparks is preferably received at the corner. In one embodiment, the vertical and horizontal surfaces are registered orthogonal to each other such that the corner is defined along 90 degrees.

In one embodiment, each of the plurality of electric sparks may terminate at a unique point defined along one of the vertical and horizontal surfaces and the corner of the electro-conductive chip respectively. In this manner, a first one of the travel paths is preferably defined between the single primary electrode and the first leg of the electro-conductive chip. A second one of the travel paths is preferably defined between the single primary electrode and the second leg of the electro-conductive chip. A third one of the travel paths is preferably defined between the single primary electrode and the corner.

The present invention further includes a method for using a spark plug with an internal combustion vehicle engine. Such a method preferably includes the chronological steps of: providing a housing having a single primary electrode and a single grounding electrode located subjacent to the single primary electrode. Such single primary and grounding electrodes are spaced apart and thereby defining a gap therebetween.

The method further includes the chronological step of: providing a mechanism for separately inducing a plurality of electric sparks between the single primary electrode and the single grounding electrode respectively. Thereafter, the method includes the chronological steps of: directly attaching the plurality of electric sparks inducing mechanism to the single grounding electrode by situating the plurality of electric sparks inducing mechanism subjacent to the single primary electrode respectively; and inducing a plurality of electric sparks between the single primary electrode and the single grounding electrode respectively. As a result of the performing the chronological steps, each of the electric sparks has a separate and mutually exclusive firing point initiating from the single primary electrode and terminating at the single grounding electrode.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
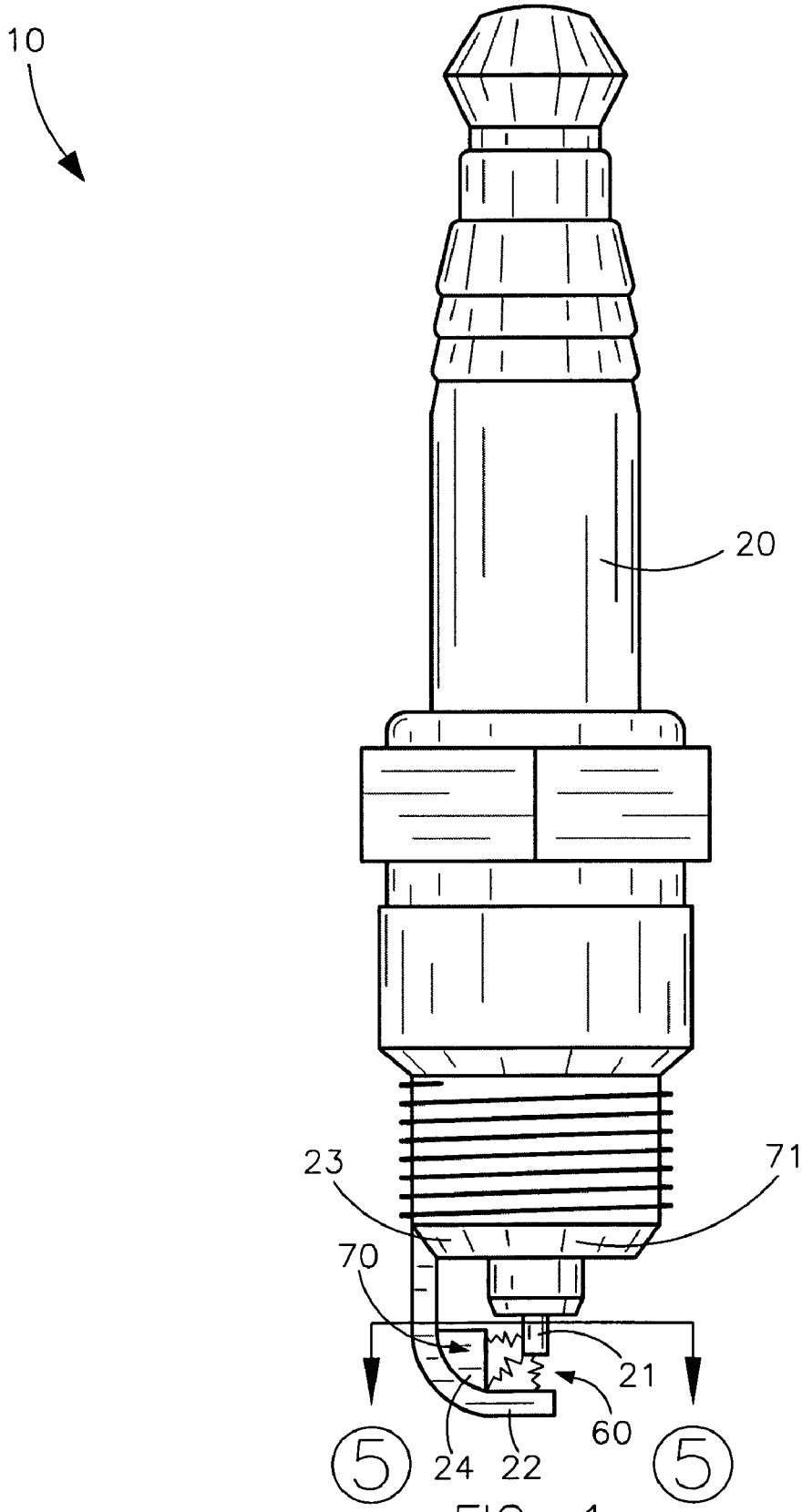
FIG. 1 is a side elevational view showing a multi-spark inducing spark plug, in accordance with the present invention.
Figure 2:
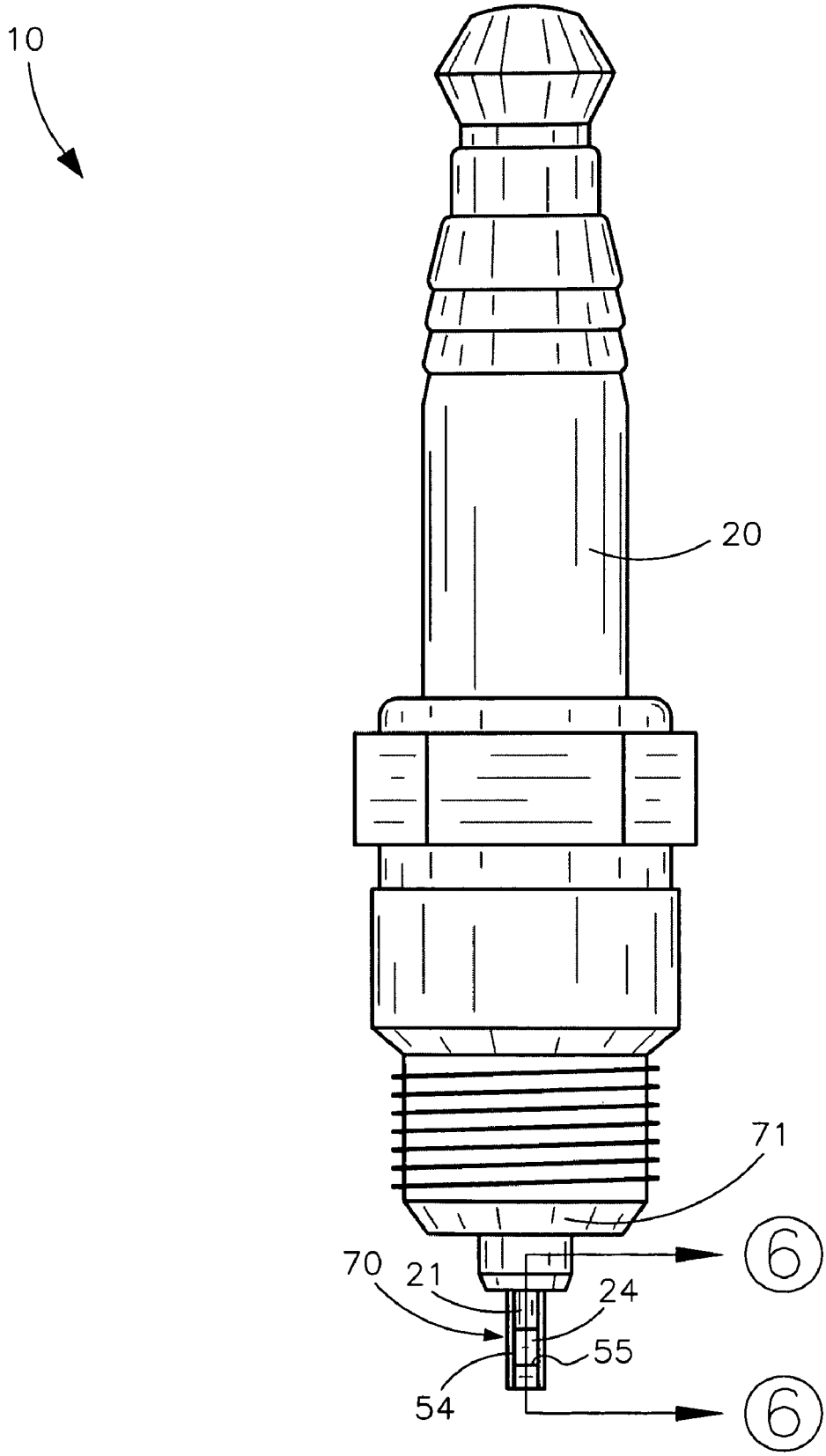
FIG. 2 is a front elevational view of the spark plug shown in FIG. 1.
Figure 3:
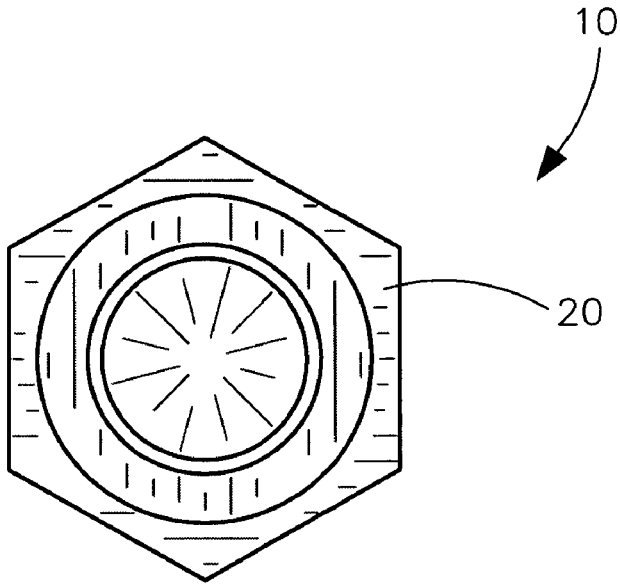
FIG. 3 is a top plan view of the spark plug shown in FIG. 1.
Figure 4:
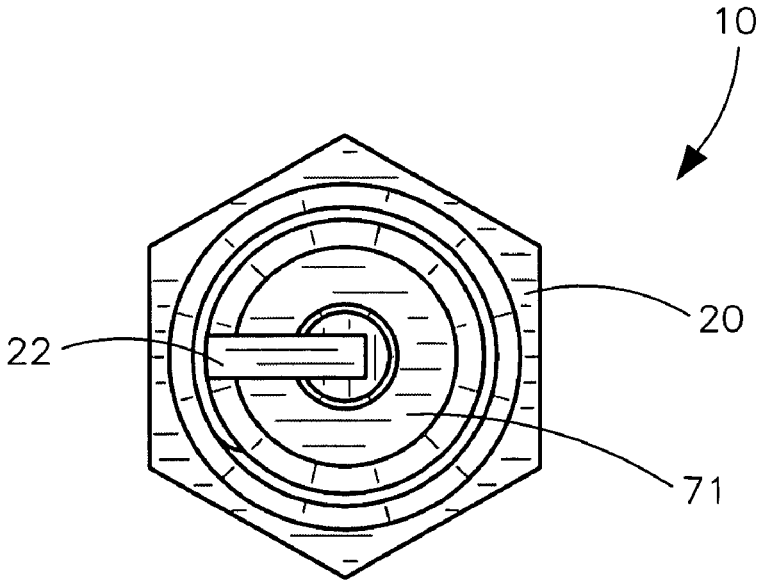
FIG. 4 is a bottom plan view of the spark plug shown in FIG. 1.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1-9 by the reference numeral 10 and is intended to provide a multi-spark inducing spark plug for use with vehicle combustion engines. It should be understood that the multi-spark inducing spark plug 10 may be used to improve fuel efficiency and operating parameters of many different types of engines and, therefore, should not be limited to use with only a vehicle combustion engine.

Referring to the figures in general, the ignition device 10 was designed for an internal combustion engine and includes a housing 20 having a primary electrode 21 extending vertically outward therefrom. A grounding electrode 22 extends from the lip 23 of the housing 20 and is located directly underneath the primary electrode 21. Such a grounding electrode 22 includes a steel or copper chip 24 embedded in the grounding electrode 22 to promote efficient production of electrical arcs 60-62.

Figure 7:
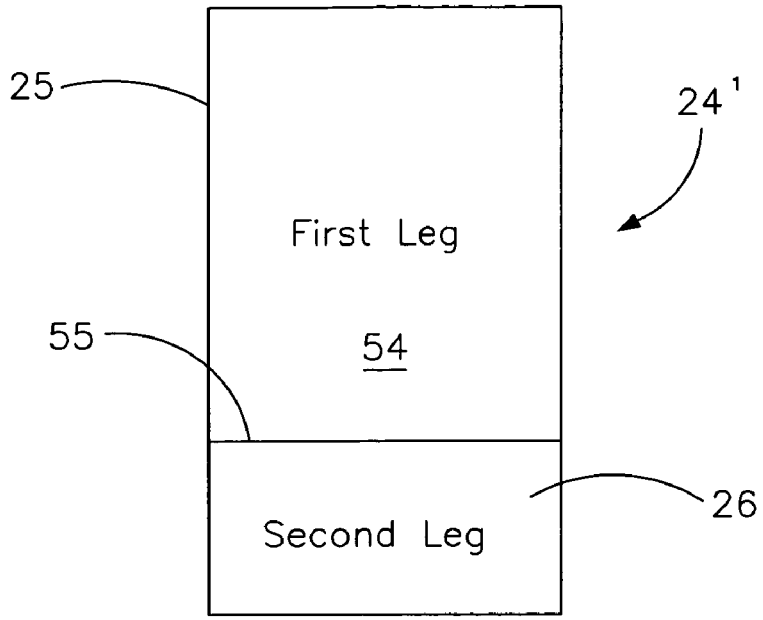
FIGS. 7-9 are enlarged front, side and top elevational views showing another embodiment of the electro-conductive chip.
Figure 8:
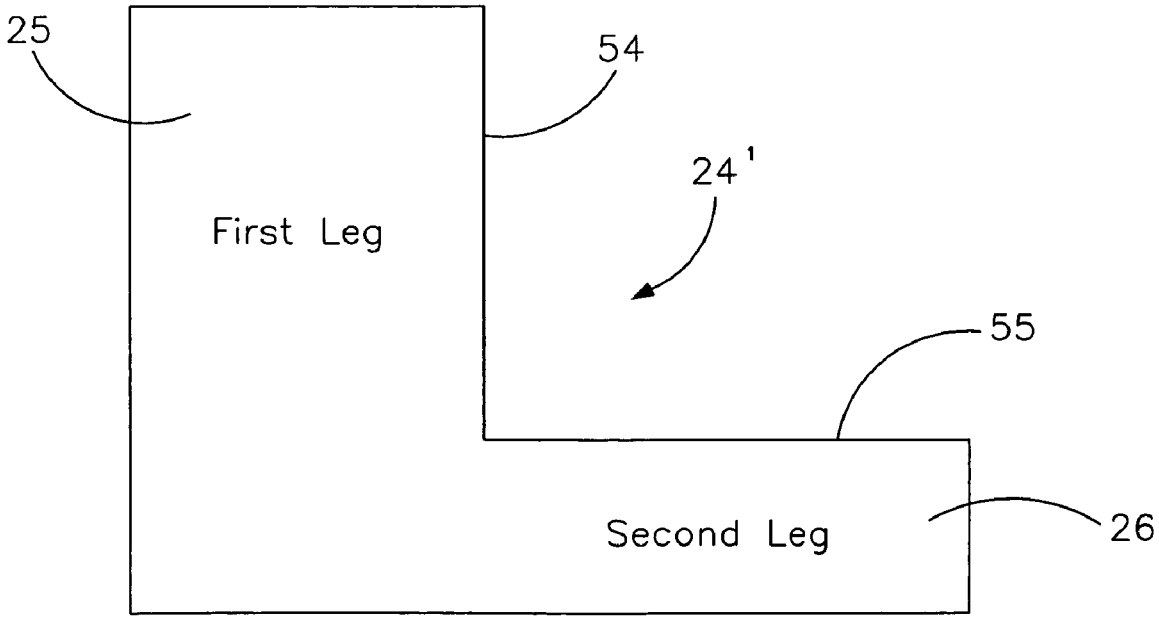
Figure 9:
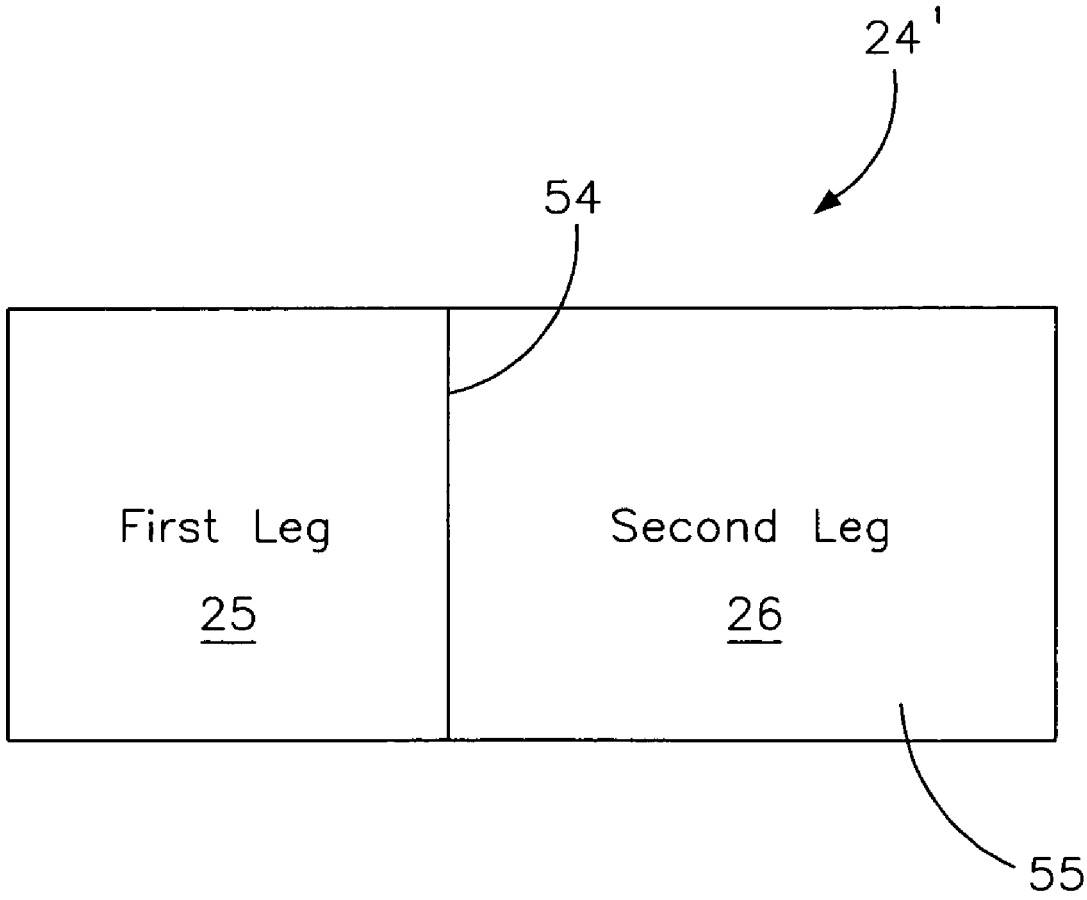

In one embodiment, the ignition device (spark plug) 10 may be a conventional spark plug that has been modified with an "L" shape chip 24' made from steel alloy, copper or platinum that is embedded deep in the spark plug grounding electrode 22, as perhaps best shown in FIGS. 7-9. The grounding electrode 22 preferably includes a steel alloy, copper or platinum chip 24 embedded deep in the grounding electrode 22 to promote efficient production of electrical arcs at multiple points along the grounding electrode 22.

Figure 6:
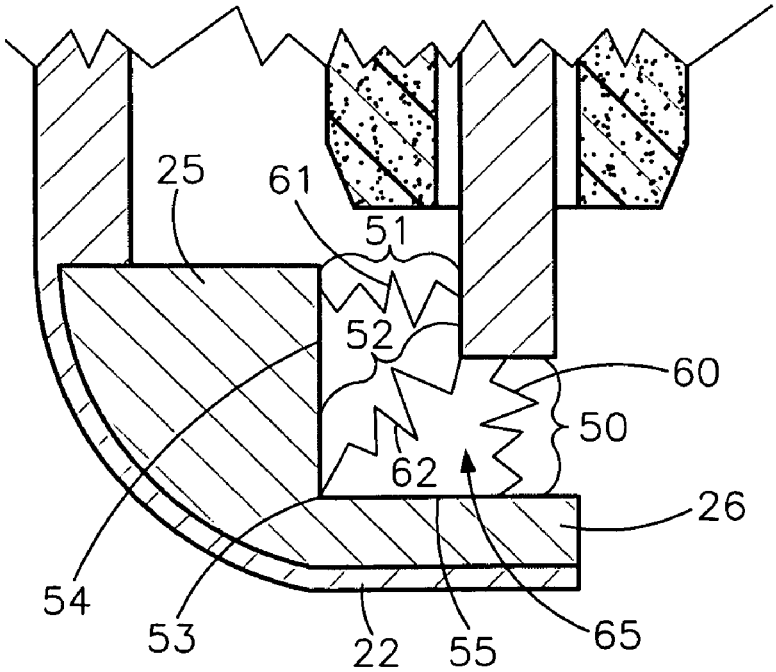
FIG. 6 is an enlarged cross-sectional view taken along line 6-6 in FIG. 1, showing one embodiment of the electro-conductive chip.

As perhaps best shown in FIGS. 1 and 6, the chip 24' is embedded deep in the grounding electrode 22, and the first leg 25 of the chip 24 protrudes vertical and lateral to the primary electrode 21. The second leg 26 of the chip 24' is located laterally underneath the primary electrode 21 and extends to the tip of the grounding electrode 22 without any part of the second leg 26 of the chip 24 protruding above the surface of the grounding electrode 22. However, the chip 24 must be exposed to the primary electrode's 21 electrical arcs 60-62. The primary electrode 21 then produces an electrical arc at multiple travel paths 50-52 along the length of the chip 24.

Also, the gap 65 setting between the primary electrode 21 and the vertical leg 25 and lateral leg 26 of the chip 24 must have an exact distance. The vertical portion of the chip's first leg 25 may measure 5/23 of an inch while the lateral portion may measure 4/32 of an inch. The lateral portion of the chip's 24 second leg 26 may measure 5½/32 of an inch and vertical 2/32 of an inch. The width of the chip 24 may measure 1 1/64 of an inch. In use, the ignition device 10 works by giving the grounding electrode 22 a larger surface area to fire on. Unlike the standard spark plug, the device 10 will now fire the length of the grounding electrode 22 from the chip 24 to the end of the grounding electrode 22 at two or more points. One essential component of the device 10 is the copper or steel chip 24 because such a chip 24 delivers more sparks from the primary electrode 21 to the grounding electrode 22 (wire) for a better burn and more power in the engine. The device 10 further has an open design that will allow it to burn the fuel better.

Referring again to FIGS. 1-6, a spark plug preferably a housing 20 having a single primary electrode 21 and a single grounding electrode 22 located subjacent to the single primary electrode 21. The single primary and grounding electrodes 21, 22 are spaced apart and thereby define a gap 65 therebetween, as perhaps best shown in FIGS. 1 and 6.

The present invention 10 further includes a mechanism 70 for separately inducing a plurality of electric sparks 60-62 between the single primary electrode 21 and the single grounding electrode 22 respectively. In one embodiment, the plurality of electric sparks inducing mechanism 70 is directly attached to the single grounding electrode 22 and situated subjacent to the single primary electrode 21 respectively.

As perhaps best shown in FIG. 6, each of the electric sparks 60-62 has a separate and mutually exclusive firing point initiating from the single primary electrode 21 and terminating at the single grounding electrode 22. In this manner, each of the electric sparks 60-62 travels along a mutually exclusive travel path 50-52 defined within the gap 65. In particular, first 60, second 61 and third 62 ones of the plurality of electric sparks travels along a corresponding one of the first 50, second 51 and third 52 distances (as described hereinbelow).

In a preferred embodiment 10, the plurality of electric sparks inducing mechanism 70 preferably includes an electro-conductive chip 24 statically and fixedly connected to the single grounding electrode 22. As an example, the electro-conductive chip 24 may be formed from a metal selected from a group including: steel alloy, copper-nickel alloy and platinum.

In one embodiment, the single primary electrode 21 is preferably attached to the distal end 71 of the housing 20 and may extend vertically downward therefrom. The single grounding electrode 22 may also extend downwardly from the distal end of the housing 20 and may further terminate at a location subjacent to the single primary electrode 21.

Figure 5:
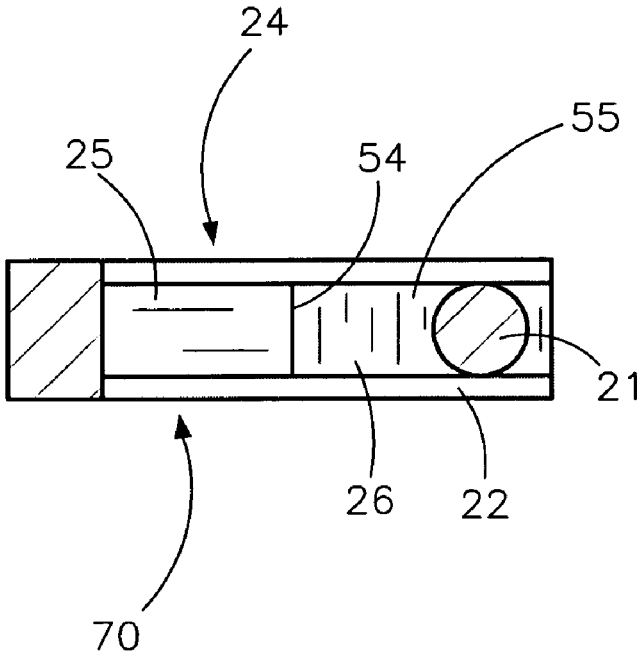
FIG. 5 is an enlarged cross-sectional view taken along line 5-5 in FIG. 1.

In a preferred embodiment, as perhaps best shown in FIGS. 5-6, the electro-conductive chip 24 preferably includes a first leg 25 having a vertical face 54 juxtaposed adjacent to the single primary electrode 21 and registered parallel thereto. The chip 24 may also include a second leg 26 having a horizontal face 55 juxtaposed beneath the single primary electrode 21 and registered orthogonal thereto. In particular, the second leg 26 preferably extends to a lateral tip of the single grounding electrode 22. Each of the vertical and horizontal faces 54, 55 are preferably planar and exposed to the single primary electrode 21 to receive first 60 and second 61 ones of the plurality of electric sparks respectively.

The vertical and horizontal faces 54, 55 may meet at a corner 53 of the first and second legs 25, 26 respectively such that a third one 62 of the plurality of electric sparks is preferably received at the corner 53. In one embodiment, the vertical and horizontal surfaces 54, 55 are registered orthogonal to each other such that the corner 53 is defined along 90 degrees.

In one embodiment, each of the plurality of electric sparks 60-62 may terminate at a unique point defined along one of the vertical and horizontal surfaces 25, 26 and the corner 53 of the electro-conductive chip 24 respectively.

In this manner, a first one 51 of the travel paths is preferably defined between the single primary electrode 21 and the first leg 25 of the electro-conductive chip 24. A second one 50 of the travel paths is preferably defined between the single primary electrode 21 and the second leg 26 of the electro-conductive chip 24. A third one 52 of the travel paths is preferably defined between the single primary electrode 21 and corner 53.

The present invention further includes a method for using a spark plug with an internal combustion vehicle engine. Such a method preferably includes the chronological steps of: providing a housing 20 having a single primary electrode 21 and a single grounding electrode 22 located subjacent to the single primary electrode 21. Such single primary and grounding electrodes 21, 22 are spaced apart and thereby defining a gap therebetween.

The method further includes the chronological step of: providing a mechanism for separately inducing a plurality of electric sparks between the single primary electrode 21 and the single grounding electrode 22 respectively. Thereafter, the method includes the chronological steps of: directly attaching the plurality of electric sparks inducing mechanism 70 to the single grounding electrode 22 by situating the plurality of electric sparks inducing mechanism subjacent to the single primary electrode 21 respectively; and inducing a plurality of electric sparks 60-62 between the single primary electrode 21 and the single grounding electrode 22 respectively.

As a result of the performing the chronological steps, each of the electric sparks 60-62 has a separate and mutually exclusive firing point initiating from the single primary electrode 21 and terminating at the single grounding electrode 22.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation.

What is claimed as new and what is desired to secure by Letters Patent of the United States is:

1. A spark plug for use with an internal combustion vehicle engine, said spark plug comprising:

a housing having a single primary electrode and a single grounding electrode located subjacent to said single primary electrode, said single primary and grounding electrodes being spaced apart and thereby defining a gap therebetween;

means for separately inducing a plurality of electric sparks between said single primary electrode and said single grounding electrode respectively;

wherein each of said electric sparks has a separate and mutually exclusive firing point initiating from said single primary electrode and terminating at said single grounding electrode;

wherein said plurality of electric sparks inducing means comprises: an electro-conductive chip statically and fixedly connected to said single grounding electrode;

wherein said electro-conductive chip comprises:

a first leg having a vertical face juxtaposed adjacent to said single primary electrode and registered parallel thereto; and a second leg having a horizontal face 55 juxtaposed beneath said single primary electrode and registered orthogonal thereto, said second leg extending to a lateral tip of said single grounding electrode;

wherein each of said vertical and horizontal faces are planar and exposed to said single primary electrode to receive first and second ones of said plurality of electric sparks respectively.

2. The spark plug of claim 1, wherein each of said electric sparks travels along a mutually exclusive travel path defined within said gap.

3. The spark plug of claim 1, wherein said single primary electrode is attached to said distal end of said housing and extends vertically downward therefrom;

wherein said single grounding electrode extends downwardly from said distal end of said housing and terminates at a location subjacent to said single primary electrode.

4. The spark plug of claim 1, wherein said vertical and horizontal faces meet at a corner of said first and second legs respectively such that a third one of said plurality of electric sparks is received at said corner.

5. The spark plug of claim 4, wherein each of said plurality of electric sparks terminates at a unique point defined along one of said vertical and horizontal surfaces and said corner of said electro-conductive chip respectively;

wherein said vertical and horizontal surfaces are registered orthogonal to each other such that said corner is defined along 90 degrees.

6. The spark plug of claim 5, wherein a first one of said travel paths is defined between said single primary electrode and said first leg of said electro-conductive chip;

wherein a second one of said travel paths is defined between said single primary electrode and said second leg of said electro-conductive chip;

wherein a third one of said travel paths is defined between said single primary electrode and said corner;

wherein first, second and third ones of said plurality of electric sparks travels along a corresponding one of said first, second and third distances.

7. The spark plug of claim 1, wherein said electro-conductive chip is formed from a metal selected from a group including: steel alloy, copper-nickel alloy and platinum.

8. A spark plug for use with an internal combustion vehicle engine, said spark plug comprising:

a housing having a single primary electrode and a single grounding electrode located subjacent to said single primary electrode, said single primary and grounding electrodes being spaced apart and thereby defining a gap therebetween;

means for separately inducing a plurality of electric sparks between said single primary electrode and said single grounding electrode respectively;

wherein each of said electric sparks has a separate and mutually exclusive firing point initiating from said single primary electrode and terminating at said single grounding electrode;

wherein said plurality of electric sparks inducing means is directly attached to said single grounding electrode and situated subjacent to said single primary electrode respectively;

wherein each of said electric sparks travels along a mutually exclusive travel path defined within said gap;

wherein said single primary electrode is attached to said distal end of said housing and extends vertically downward therefrom;

wherein said single grounding electrode extends downwardly from said distal end of said housing and terminates at a location subjacent to said single primary electrode;

wherein said plurality of electric sparks inducing means comprises: an electro-conductive chip statically and fixedly connected to said single grounding electrode;

wherein said electro-conductive chip comprises:

a first leg having a vertical face juxtaposed adjacent to said single primary electrode and registered parallel thereto; and a second leg having a horizontal face 55 juxtaposed beneath said single primary electrode and registered orthogonal thereto, said second leg extending to a lateral tip of said single grounding electrode;

wherein each of said vertical and horizontal face 55*s* are planar and exposed to said single primary electrode to receive first and second ones of said plurality of electric sparks respectively.

9. The spark plug of claim 8, wherein said vertical and horizontal face s meet at a corner of said first and second legs respectively such that a third one of said plurality of electric sparks is received at said corner.

10. The spark plug of claim 9, wherein each of said plurality of electric sparks terminates at a unique point defined along one of said vertical and horizontal surfaces and said corner of said electro-conductive chip respectively;

wherein said vertical and horizontal surfaces are registered orthogonal to each other such that said corner is defined along 90 degrees.

11. The spark plug of claim 10, wherein a first one of said travel paths is defined between said single primary electrode and said first leg of said electro-conductive chip;

wherein a second one of said travel paths is defined between said single primary electrode and said second leg of said electro-conductive chip;

wherein a third one of said travel paths is defined between said single primary electrode and said corner;

wherein first, second and third ones of said plurality of electric sparks travels along a corresponding one of said first, second and third distances.

12. The spark plug of claim 8, wherein said electro-conductive chip is formed from a metal selected from a group including: steel alloy, copper-nickel alloy and platinum.

* * * * *